US011004296B2

(12) United States Patent
Nada

(10) Patent No.: US 11,004,296 B2
(45) Date of Patent: May 11, 2021

(54) SHEET PROCESSING APPARATUS AND SHEET PROCESSING METHOD

(71) Applicant: GLORY LTD., Hyogo (JP)

(72) Inventor: Keisuke Nada, Hyogo (JP)

(73) Assignee: GLORY LTD., Hyogo (JP)

( * ) Notice: Subject to any disclaimer, the term of this patent is extended or adjusted under 35 U.S.C. 154(b) by 73 days.

(21) Appl. No.: 16/452,820

(22) Filed: Jun. 26, 2019

(65) Prior Publication Data

US 2020/0005578 A1 Jan. 2, 2020

(30) Foreign Application Priority Data

Jun. 27, 2018 (JP) ..... JP2018-122136

(51) Int. Cl.

| | |
|---|---|
| ***G07D 11/50*** | (2019.01) |
| ***G07D 11/16*** | (2019.01) |
| ***G07D 7/121*** | (2016.01) |
| ***G07D 11/32*** | (2019.01) |
| ***G07D 11/34*** | (2019.01) |
| ***G07D 11/30*** | (2019.01) |

(52) U.S. Cl.

CPC ..... *G07D 11/50* (2019.01); *G07D 7/121* (2013.01); *G07D 11/16* (2019.01); *G07D 11/30* (2019.01); *G07D 11/32* (2019.01); *G07D 11/34* (2019.01); *B65H 2701/1912* (2013.01)

(58) Field of Classification Search

CPC ..... G07D 11/50; G07D 11/16; G07D 7/121; G07D 11/32; G07D 11/34; G07D 11/30; B65H 2701/1912

See application file for complete search history.

(56) References Cited

U.S. PATENT DOCUMENTS

| | | | | |
|---|---|---|---|---|
| 2012/0243056 | A1* | 9/2012 | Yamaguchi | G06K 9/03 358/462 |
| 2014/0144750 | A1 | 5/2014 | Shimizu et al. | |
| 2017/0076531 | A1* | 3/2017 | Nada | G07D 11/30 |
| 2017/0278358 | A1 | 9/2017 | Ino et al. | |
| 2019/0172292 | A1 | 6/2019 | Fukuda et al. | |

FOREIGN PATENT DOCUMENTS

| | | | | |
|---|---|---|---|---|
| JP | 2012-141863 | | 7/2012 | |
| JP | 5585620 | | 9/2014 | |
| JP | 6086652 | B2 * | 3/2017 | G07D 9/00 |
| JP | 6089707 | B2 * | 3/2017 | G06Q 40/02 |
| KR | 2018-0038150 | | 4/2018 | |
| WO | 2018/021156 | | 2/2018 | |

OTHER PUBLICATIONS

Extended European Search Report issued for corresponding European Patent Office Application No. 19182245.1, dated Nov. 14, 2019.

Office Action dated Jan. 27, 2021 issued in European patent application No. 19182245.1-1009.

* cited by examiner

*Primary Examiner* — Zhitong Chen

(74) *Attorney, Agent, or Firm* — Greenblum & Bernstein, P.L.C.

(57) ABSTRACT

A sheet processing apparatus includes: storage units that each stores therein a sheet with a serial number; a recognition unit that performs first reading processing to read the serial number from the sheet transported from each of the storage units; and a control section that retrieves the serial number having a predetermined relationship relating to a degree of coincidence with the serial number read in the first reading processing, from a serial number list of the sheets stored in the storage units.

10 Claims, 12 Drawing Sheets

| SERIAL NUMBER AT DEPOSITING | SERIAL NUMBER AT DISPENSING |
|---|---|
| A123456789 | A1234?6789 |
| B234567891 | ?????????? |
| D456789123 | D4567????3 |
| G789123456 | G78?23456? |

FIG. 8

40

| FEEDING ORDER | SERIAL NUMBER |
|---|---|
| 1 | A1234?6789 |
| 2 | ?????????? |
| 3 | C345678912 |
| 4 | D456789??3 |
| 5 | E567891234 |
| 6 | F678912345 |
| 7 | G78?23456? |
| 8 | H891234567 |
| 9 | I912345678 |
| 10 | J123456789 |
| 11 | ?????????? |
| 12 | M456789123 |
| 13 | N567891234 |
| 14 | F678912345 |
| 15 | O789123456 |
| 16 | P891234567 |
| 17 | Q912345678 |
| 18 | R123456789 |
| 19 | S234567891 |
| 20 | T345678912 |
| 21 | U456789123 |
| 22 | V567891234 |
| 23 | W678912345 |
| 24 | X789123456 |
| ... | ... |

41

| STORING ORDER | SERIAL NUMBER |
|---|---|
| 28 | A123456789 |
| 27 | B234567891 |
| 26 | C345678912 |
| 25 | D456789123 |
| 24 | E567891234 |
| 23 | F678912345 |
| 22 | G789123456 |
| 21 | H891234567 |
| 20 | I912345678 |
| 19 | J123456789 |
| 18 | K234567891 |
| 17 | L345678912 |
| 16 | M456789123 |
| 15 | N567891234 |
| 14 | F678912345 |
| 13 | O789123456 |
| 12 | P891234567 |
| 11 | Q912345678 |
| 10 | R123456789 |
| 9 | S234567891 |
| 8 | T345678912 |
| 7 | U456789123 |
| 6 | V567891234 |
| 5 | W678912345 |
| ... | ... |

48

| FEEDING ORDER | SERIAL NUMBER (AFTER CORRECTION) |
|---|---|
| 1 | A123456789 |
| 2 | ?????????? |
| 3 | C345678912 |
| 4 | D456789123 |
| 5 | E567891234 |
| 6 | F678912345 |
| 7 | G789123456 |
| 8 | H891234567 |
| 9 | I912345678 |
| 10 | J123456789 |
| 11 | ?????????? |
| 12 | M456789123 |
| 13 | N567891234 |
| 14 | F678912345 |
| 15 | O789123456 |
| 16 | P891234567 |
| 17 | Q912345678 |
| 18 | R123456789 |
| 19 | S234567891 |
| 20 | T345678912 |
| 21 | U456789123 |
| 22 | V567891234 |
| 23 | W678912345 |
| 24 | X789123456 |
| ... | ... |

FIG. 10

50

| STORING ORDER | DENOMINATION | SERIAL NUMBER | CATEGORY | AUTHENTICITY FACTOR | FITNESS FACTOR |
|---|---|---|---|---|---|
| 38 | USD | A00001 | 4A | ALL OK | ALL OK |
| 37 | USD | A00002 | 4A | ALL OK | ALL OK |
| 36 | USD | A00003 | 4B | ALL OK | FACTOR 1 |
| 35 | USD | A00004 | 4A | ALL OK | ALL OK |
| 34 | USD | A00005 | 4A | ALL OK | ALL OK |
| 33 | USD | A00006 | 4A | ALL OK | ALL OK |
| 32 | USD | A00007 | 4A | ALL OK | ALL OK |
| 31 | USD | A00008 | 4B | ALL OK | FACTOR 2 |
| 30 | USD | A00009 | 4A | ALL OK | ALL OK |
| 29 | USD | A00010 | 4A | ALL OK | ALL OK |
| 28 | USD | A00011 | 4A | ALL OK | ALL OK |
| 27 | USD | A00012 | 4A | ALL OK | ALL OK |
| 26 | USD | A00013 | 4A | ALL OK | ALL OK |
| 25 | USD | A00014 | 4A | ALL OK | ALL OK |
| 24 | USD | A00015 | 4A | ALL OK | ALL OK |
| 23 | USD | A00016 | 4A | ALL OK | ALL OK |
| 22 | USD | A00017 | 4A | ALL OK | ALL OK |
| 21 | USD | A00018 | 4A | ALL OK | ALL OK |
| 20 | USD | A00019 | 4A | ALL OK | ALL OK |
| 19 | USD | A00020 | 4B | ALL OK | FACTOR 3 |
| 18 | USD | A00021 | 4A | ALL OK | ALL OK |
| 17 | USD | A00022 | 4A | ALL OK | ALL OK |
| 16 | USD | A00023 | 4A | ALL OK | ALL OK |
| 15 | USD | A00024 | 4A | ALL OK | ALL OK |
| : | : | : | : | : | : |
| 2 | USD | A00037 | 4A | ALL OK | ALL OK |
| 1 | USD | A00038 | 4A | ALL OK | ALL OK |

FIG. 11

51

| FEEDING ORDER | DENOMINATION | SERIAL NUMBER | CATEGORY | AUTHENTICITY FACTOR | FITNESS FACTOR |
|---|---|---|---|---|---|
| 1 | USD | A00001 | 4A | ALL OK | ALL OK |
| 2 | USD | A00002 | 4A | ALL OK | ALL OK |
| 3 | USD | A00003 | 4B | ALL OK | FACTOR 1 |
| 4 | USD | A00004 | 4A | ALL OK | ALL OK |
| 5 | USD | A00005 | 4A | ALL OK | ALL OK |
| 6 | USD | A00006 | 4A | ALL OK | ALL OK |
| 7 | USD | A00007 | 4A | ALL OK | ALL OK |
| 8 | USD | A00008 | 4B | ALL OK | FACTOR 2 |
| 9 | USD | A00009 | 4A | ALL OK | ALL OK |
| 10 | USD | A00010 | 4A | ALL OK | ALL OK |
| 11 | USD | A00011 | 4A | ALL OK | ALL OK |
| 12 | USD | A00012 | 4A | ALL OK | ALL OK |
| 13 | USD | A00013 | 4A | ALL OK | ALL OK |

FIG 12

SHEET PROCESSING APPARATUS AND SHEET PROCESSING METHOD

CROSS REFERENCE TO RELATED APPLICATIONS

This application is entitled to (or claims) the benefit of Japanese Patent Application No. 2018-122136, filed on Jun. 27, 2018, the disclosure of which including the specification, drawings and abstract is incorporated herein by reference in its entirety.

TECHNICAL FIELD

The present invention relates to a sheet processing apparatus and a sheet processing method.

BACKGROUND ART

Conventionally, as an apparatus to/from which banknotes are deposited or dispensed in financial institutions and the like, a sheet processing apparatus is used. The sheet processing apparatus comprises a recognition unit that recognizes the banknotes, a storage apparatus that stores the banknotes, a temporary storage apparatus that temporarily stores the banknotes, and the like. The banknotes are transported to the temporary storage apparatus, the storage apparatus, and the like based on a result of the recognition by the recognition unit.

Patent literature (hereinafter, referred to as "PTL") 1 discloses a sheet processing apparatus that sequentially reads serial numbers of banknotes by a recognition unit as well as records the serial numbers in a storage apparatus in reading order in depositing processing. Further, the sheet processing apparatus disclosed in PTL 1 sequentially reads the serial numbers by the recognition unit and records the serial numbers in the storage apparatus in the reading order also in dispensing processing.

For example, in a case where the banknotes are damaged or are dirty, however, the serial numbers may not be read by the recognition unit.

If reading failure of the serial number occurs at the dispensing, the existing sheet processing apparatus corrects the serial number that cannot be read, by the serial numbers read at the depositing, thereby performing the dispensing processing. The existing sheet processing apparatus specifies depositing order of the banknotes from feeding order of the banknotes, and specifies the serial numbers read at the depositing.

CITATION LIST

Patent Literature

PTL 1
Japanese Patent Application Laid-Open No. 2012-141863

SUMMARY OF INVENTION

Technical Problem

When the serial numbers read at the depositing are specified in the above-described manner, if a plurality of banknotes is overlapped and fed out or the banknotes are transported while the feeding order of the banknotes is changed at the dispensing, the serial number of the banknote different from the banknote, the serial number of which cannot be read, may be specified, and the serial number may be corrected to an incorrect serial number.

An object of the present invention is to provide a sheet processing apparatus that makes it possible to appropriately correct a serial number in a case where a recognition unit cannot appropriately read the serial number.

Solution to Problem

In order to achieve the object mentioned above, a sheet processing apparatus of the present invention comprises: a storage unit that stores therein a sheet with a serial number; a recognition unit that performs first reading processing to read the serial number from the sheet transported from the storage unit; and a control section that retrieves, from a serial number list of the sheet stored in the storage unit, the serial number having a predetermined relationship relating to a degree of coincidence with the serial number read in the first reading processing.

Further, in order to achieve the object mentioned above, a sheet processing method of the present invention includes: reading a serial number of a sheet transported from a storage unit; and retrieving, from a serial number list of the sheet stored in the storage unit, the serial number having a predetermined relationship relating to a degree of coincidence with the read serial number.

Advantageous Effects of Invention

The sheet processing apparatus according to the present invention can appropriately correct the serial number in the case where the recognition unit cannot appropriately read the serial number.

BRIEF DESCRIPTION OF DRAWINGS

FIG. 8 is a diagram illustrating reading failure of a serial number;

FIG. 10 is a diagram illustrating retrieval processing according to Embodiment 1;

FIG. 11 is a diagram illustrating a storage table according to Embodiment 2; and FIG. 12 is a diagram illustrating an example of a dispensing table according to Embodiment 2.

DESCRIPTION OF EMBODIMENTS

Figure 1:
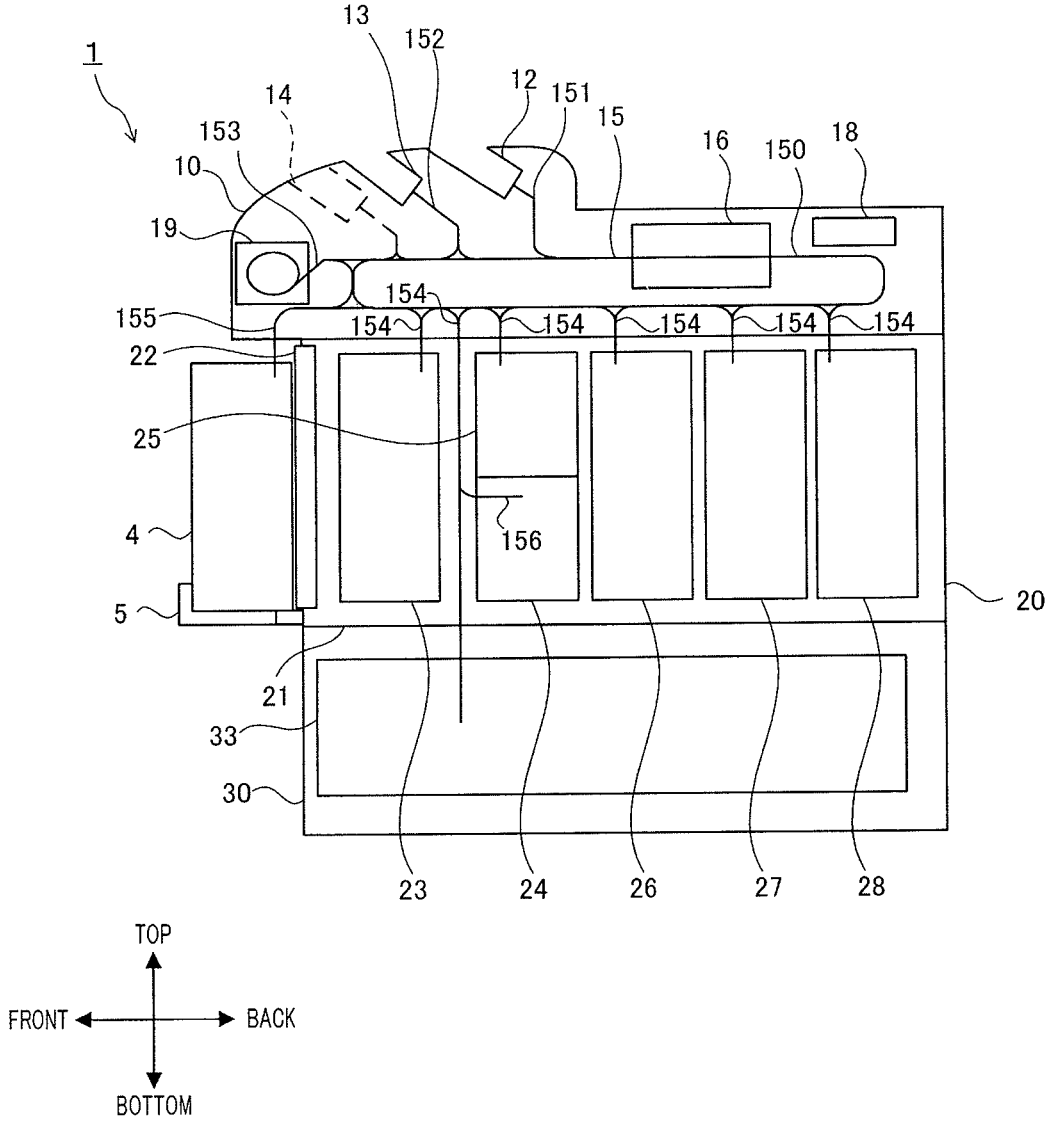
FIG. 1 is a diagram illustrating an example of an entire configuration of a sheet processing apparatus according to Embodiment 1.

Some embodiments of the present invention are described below with reference to accompanying drawings. Note that like components are denoted by like reference numerals. Further, the accompanying drawings each schematically illustrate the components to facilitate understanding. In addition, in the present specification, directions of arrows illustrated in the accompanying drawings are regarded as top, bottom, front and back.

Further, in the present specification, a sheet processing apparatus is described with use of a banknote as an example of a sheet. The sheet, however, is not limited to the banknote, and may be valuable securities such as a bill and a check.

Embodiment 1

FIG. 1 is a diagram illustrating an example of an entire configuration of a sheet processing apparatus according to Embodiment 1. A sheet processing apparatus 1 is a banknote depositing and dispensing machine to/from which banknotes are deposited and dispensed. The sheet processing apparatus 1 comprises a housing including an upper housing 10 and a lower housing 20.

The upper housing 10 comprises a depositing section 12 which deposits banknotes from outside of the housing, and a dispensing section 13 which dispenses the deposited banknotes to outside of the housing, at an upper part of the housing. Further, the upper housing 10 internally comprises a transport unit 15 that transports the banknotes deposited by the depositing section 12, a recognition unit 16 that recognizes the banknotes transported by the transport unit 15, a control section 18 that controls each of sections and units of the sheet processing apparatus 1. Further, a temporary storage section 19 that temporarily stores the banknotes is provided in the upper housing 10, and a second dispensing section 14 may be provided adjacently to the dispensing section 13 as necessary. The second dispensing section 14 may have a configuration similar to or different from a configuration of the dispensing section 13.

A banknote feeding mechanism (not illustrated) that feeds out the banknotes one by one toward the transport unit 15 in a predetermined cycle is disposed in the depositing section 12. Further, a stacking mechanism (not illustrated) that stacks the transported banknotes is disposed in the dispensing section 13.

The transport unit 15 transports the banknotes recognized by the recognition unit 16 to a storage unit in the lower housing 20 (Details are described below). Further, the transport unit 15 transports the banknotes stored in the storage unit to the dispensing section 13. The transport unit 15 transports the banknotes at a predetermined transport speed. The transport unit 15 is configured of a belt mechanism and a roller mechanism that transports the banknotes. The transport unit 15 comprises a loop transport path 150 that transports the banknotes in a loop, and a first diversion path 151, a second diversion path 152, a third diversion path 153, a fourth diversion path 154, and a fifth diversion path 155 that are diverged from the loop transport path 150.

The first diversion path 151 connects the depositing section 12 to the loop transport path 150, the second diversion path 152 connects the dispensing section 13 to the loop transport path 150, the third diversion path 153 connects the temporary storage section 19 to the loop transport path 150, the fourth diversion path 154 connects a first storage box 21 and a second storage box 30 described below to the loop transport path 150, and the fifth diversion path 155 connects a detachable storage unit 4 described below to the loop transport path 150. A diverter (not illustrated) that diverts the banknotes is disposed at a connection portion between each of the first diversion path 151 to the fifth diversion path 155 and the loop transport path 150.

The recognition unit 16 reads information on each of the banknotes to recognize the banknotes transported by the transport unit 15 from the depositing section 12 to the storage unit or the banknotes transported by the transport unit 15 from the storage unit to the dispensing section 13. The recognition unit 16 comprises a sensor such as an image sensor, an optical sensor, and a magnetic sensor, and recognizes banknote information including a serial number of each of the banknotes transported by the transport unit 15. The recognition unit 16 further recognizes the banknote information including authenticity, a denomination, and fitness of each of the banknotes transported by the transport unit 15.

The serial number is a number that identifies each banknote, and is configured of, for example, a string of ten characters including alphabets and numbers. The recognition unit 16 recognizes each often characters configuring the serial number.

The temporary storage section 19 temporarily stores the banknotes. The temporary storage section 19 can take in and store the banknotes one by one, and can feed out the stored banknotes one by one.

The temporary storage section 19 is configured of, for example, a winding-type storage unit in which a plurality of banknotes is stored while being wound around a rotor. Further, the temporary storage section 19 may be configured of a stacking-type storage unit in which a plurality of banknotes is stored in a stacked state.

The control section 18 is a controlling apparatus that comprises a processing section such as a CPU and a memory section such as a memory. The control section 18 controls the sections configuring the sheet processing apparatus 1 and the detachable storage unit 4 described below so as to transport the banknotes among the depositing section 12, the dispensing section 13, the temporary storage section 19, the first storage box 21 and the second storage box 30 described below, and the detachable storage unit 4 through the transport unit 15. It is possible that the control section 18 does not comprise the memory section and that the memory section is separate from the control section 18 and provided in the sheet processing apparatus 1.

The memory section stores tables, in other word, lists such as a transport table, first to sixth storage tables, and a temporary storage table. The transport table includes the banknote information such as the serial number of each of the banknotes transported by the transport unit 15. The transport table, further includes the banknote information such as the denomination of each of the banknotes transported by the transport unit 15. The first to sixth storage tables respectively include the banknote information on the banknotes stored in first to sixth storage units described below. The temporary storage table includes the banknote information on the banknotes stored in the temporary storage section 19. The banknote information included in the first to sixth storage tables and the temporary storage table may be banknote information on the banknotes stored in depositing processing. In this case, the banknote information read in the depositing processing is recorded in the memory section. Further, the banknote information included in each of the tables may be banknote information on banknotes stored by the other apparatus or banknote information on banknotes stored manually. For example, in a case where the first storage unit in which the banknotes are stored by an apparatus other than the sheet processing apparatus 1 is used by being attached to the sheet processing apparatus 1, the banknote information on the stored banknotes is created by the other apparatus. The sheet processing apparatus 1 receives the banknote information created by the other apparatus and records the banknote information as a first storage table in the memory section.

In addition, the memory section stores tables including banknote information such as a detachable-storage table and a dispensing table. The detachable-storage table includes banknote information on the banknotes stored in the detachable storage unit described below. The dispensing table includes banknote information on the dispensed banknotes. The banknote information included in the detachable-storage table may be banknote information on banknotes stored in collection processing or reconciliation processing. In this case, the banknote information read in the collection processing or the reconciliation processing is stored in the memory section. Further, the banknote information included in the detachable-storage table may be banknote information on the banknotes stored by the other apparatus, or banknote information on the banknotes stored manually. For example, in a case where the detachable storage unit in which the banknotes are stored by an apparatus other than the sheet processing apparatus 1 is used by being attached to the sheet processing apparatus 1, the banknote information on the stored banknotes is created by the other apparatus. The sheet processing apparatus 1 receives the banknote information created by the other apparatus and records the banknote information as the detachable-storage table in the memory section.

The banknote information on the banknotes located in the transport unit 15 or the storage units is included in any of these tables. In other words, the location of each of the banknotes can be specified with reference to the information included in these tables. Further, in a case where the banknote information is a serial number, these tables correspond to serial number lists.

The lower housing 20 of the housing comprises a storage unit including the first storage box 21 and the second storage box 30 disposed below the first storage box 21.

The first storage box 21 is configured of, for example, a safe. A lockable storage door 22 is disposed on front surface side of the first storage box 21.

In the first storage box 21, a first storage unit 23, a second storage unit 24 and a third storage unit 25 that is disposed on upper side of the second storage unit 24, a fourth storage unit 26, a fifth storage unit 27, and a sixth storage unit 28 are disposed in order from front side. Further, the fourth diversion path 154 that extends from the loop transport path 150 toward the second storage box 30 is disposed between the first storage unit 23 and both of the second storage unit 24 and the third storage unit 25.

The fourth diversion path 154 diverged from the loop transport path 150 is connected to the first storage unit 23 and the third storage unit 25 to the sixth storage unit 28. In addition, the sixth diversion path 156 diverged from the fourth diversion path 154 that extends from the loop transport path 150 toward the second storage box 30 is connected to the second storage unit 24.

Each of the first storage unit 23 to the sixth storage unit 28 is a stacking-type storage unit in which a plurality of banknotes is stored in a stacked state. Further, each of the first storage unit 23 to the sixth storage unit 28 may be a winding-type storage unit in which a plurality of banknotes is stored while being wound around a rotor. The banknotes sorted based on a result of the recognition by the recognition unit 16 are stored in each of the first storage unit 23 to the sixth storage unit 28.

A sensor (not illustrated) that detects passage of each of the banknotes is disposed at an inlet of each of the first storage unit 23 to the sixth storage unit 28. The sensor is, for example, an optical sensor that comprises a light emission section emitting light such as infrared rays, and a light reception section receiving light from the light emission section. Note that the sensor may be of any type as long as the sensor can detect storage of the banknotes in each of the storage units.

The second storage box 30 is configured of, for example, a safe. Further, the second storage box 30 internally comprises a collection section 33. The collection section 33 internally comprises a storage region. Out of the banknotes deposited through the depositing section 12 and the banknotes stored in the first storage box 21, banknotes to be collected are stored in the storage region. The collection section 33 is connected to the fourth diversion path 154 diverged from the loop transport path 150.

After the banknotes to be collected are stored in the collection section 33, the banknotes are collected by a collection worker from the collection section 33. Alternatively, after the banknotes to be collected are stored in the collection section 33, the collection section 33 is detached from the sheet processing apparatus 1 by the collection worker and is collected together with the banknotes.

The lower housing 20 comprises an attachment section 5 to which the detachable storage unit 4 is attached, on an outer surface on the front surface side of the first storage box 21. Note that the outer surface of the first storage box 21 is an outer surface of the first storage box 21 accessible without unlocking of the locked storage door 22. More specifically, the outer surface of the first storage box 21 is an outer surface of the lower housing 20 or an outer surface of the storage door 22.

The attachment section 5 comprises a fixing tool to fix the detachable storage unit 4 attached to the attachment section 5. The fixing tool may comprise a locking apparatus.

The attachment section 5 comprises a terminal (not illustrated) to supply a control signal from the control section 18 to the detachable storage unit 4. Further, the detachable storage unit 4 comprises a terminal (not illustrated) to be connected to the terminal of the attachment section 5.

When the detachable storage unit 4 is attached to the attachment section 5, the terminal of the detachable storage unit 4 and the terminal of the attachment section 5 are directly or indirectly connected to each other. In addition, when the detachable storage unit 4 is attached to the attachment section 5, a storage region inside the detachable storage unit 4 is connected to the fifth diversion path 155.

The detachable storage unit 4 is a stacking-type storage unit in which a plurality of banknotes is stored in a stacked state. The detachable storage unit 4 may be a winding-type storage unit in which a plurality of banknotes is stored while being wound around a rotor.

The detachable storage unit 4 comprises a driving mechanism (not illustrated) including a motor to store the banknotes to inside and to feed out the banknotes to outside. Alternatively, in a case where the detachable storage unit 4 does not comprise the driving mechanism, the sheet processing apparatus 1 comprises a driving mechanism, and transmits driving force to the detachable storage unit 4 attached to the attachment section 5.

Note that the detachable storage unit 4 may be attached inside the first storage box 21. In this case, the lockable storage door 22 is disposed inside the first storage box 21, and the attachment section 5 to which the detachable storage unit 4 is attached is disposed outside the storage door 22. In addition, for example, a front door that does not comprise a locking apparatus and allows for access to the inside of the first storage box 21 through rotation of an opening/closing knob is disposed outside the attachment section 5. Further, the first storage unit 23 to the sixth storage unit 28 are disposed inside the storage door 22.

As a result, it is possible to easily access the attachment section 5 to attach or detach the detachable storage unit 4 while securing a high security level for the first storage unit 23 to the sixth storage unit 28. Note that the front door may comprise a locking apparatus.

Next, various kinds of processing performed by the sheet processing apparatus 1 are described. First, depositing processing executed in Embodiment 1 is described.

The depositing processing is processing to read banknotes fed out from the depositing section 12 into the housing by the recognition unit 16, and to store banknotes other than rejected banknotes such as an unfit note and a counterfeit note, in the sheet processing apparatus 1. The recognition unit 16 recognizes banknote information including at least a serial number of each of the banknotes. The recognition unit 16 can recognize the banknote information further including authenticity, fitness, and a denomination of each of the banknotes.

The sheet processing apparatus 1 according to Embodiment 1 performs the depositing processing referred to as direct depositing processing or depositing processing referred to as holding and depositing processing.

Figure 2:
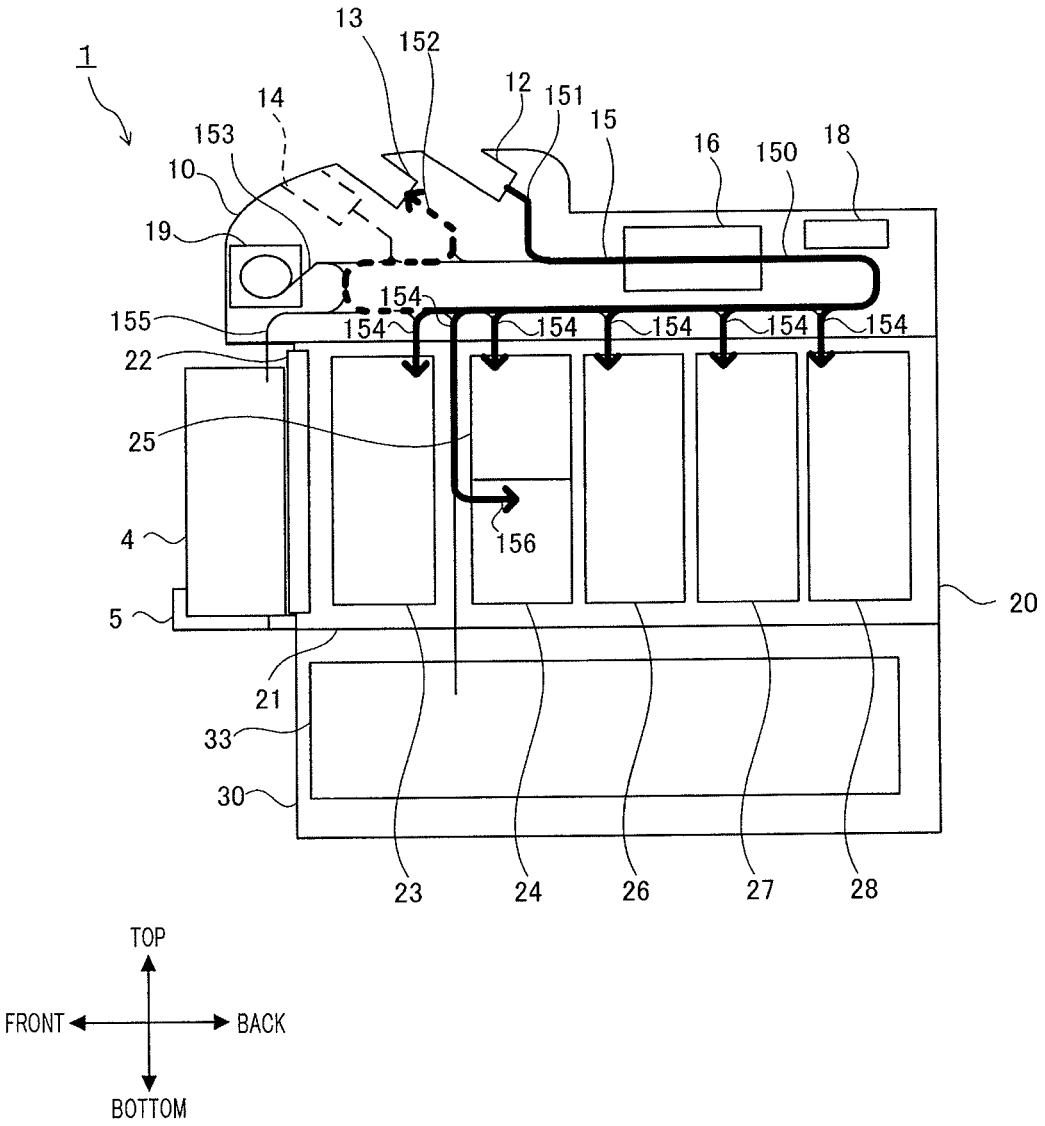
FIG. 2 is a diagram illustrating direct depositing processing by the sheet processing apparatus according to Embodiment 1.

FIG. 2 is a diagram illustrating the direct depositing processing according to Embodiment 1. The direct depositing processing is depositing processing to directly store the banknotes recognized by the recognition unit 16 in any of the first storage unit 23 to the sixth storage unit 28.

Out of the first storage unit 23 to the sixth storage unit 28, the storage unit to which each of the banknotes is to be stored is determined based on, for example, the denomination and the serial number of each of the banknotes read by the recognition unit 16. An arrow drawn by a dashed line in the figure indicates a transport path of the rejected banknotes rejected in the depositing processing.

In the direct depositing processing, the banknotes are directly stored from the transport unit 15 to any of the first storage unit 23 to the sixth storage unit 28. This allows for quick depositing processing.

In addition, in the direct depositing processing, the read serial numbers of the respective banknotes are included, in a reading order, in any of a first storage table to a sixth storage table that are provided respectively corresponding to the first storage unit 23 to the sixth storage unit 28. This makes it possible to specify that each of the banknotes is stored in which storage unit in what order.

Moreover, when the denomination and the serial number of each of the banknotes are read by the recognition unit 16, the storage unit to which each of the banknotes is to be stored is determined out of the first storage unit 23 to the sixth storage unit 28. Accordingly, even if a transport error such as jam occurs during execution of the direct depositing processing, the storage unit to which each of the banknotes is to be stored can be specified, and recovery processing can be quickly performed.

Figure 3:
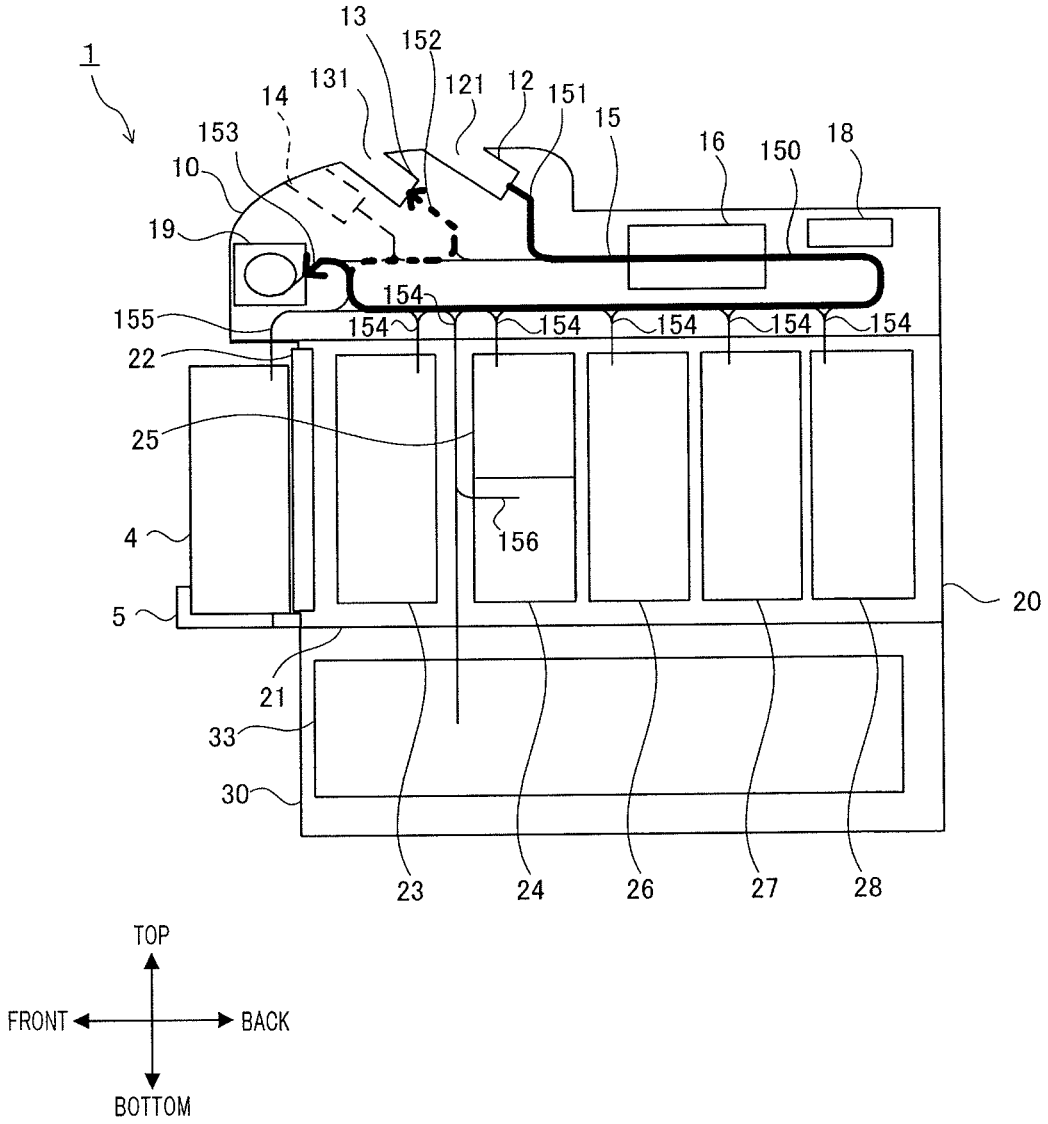
FIG. 3 is a diagram illustrating an example of holding and depositing processing according to Embodiment 1.
Figure 4:
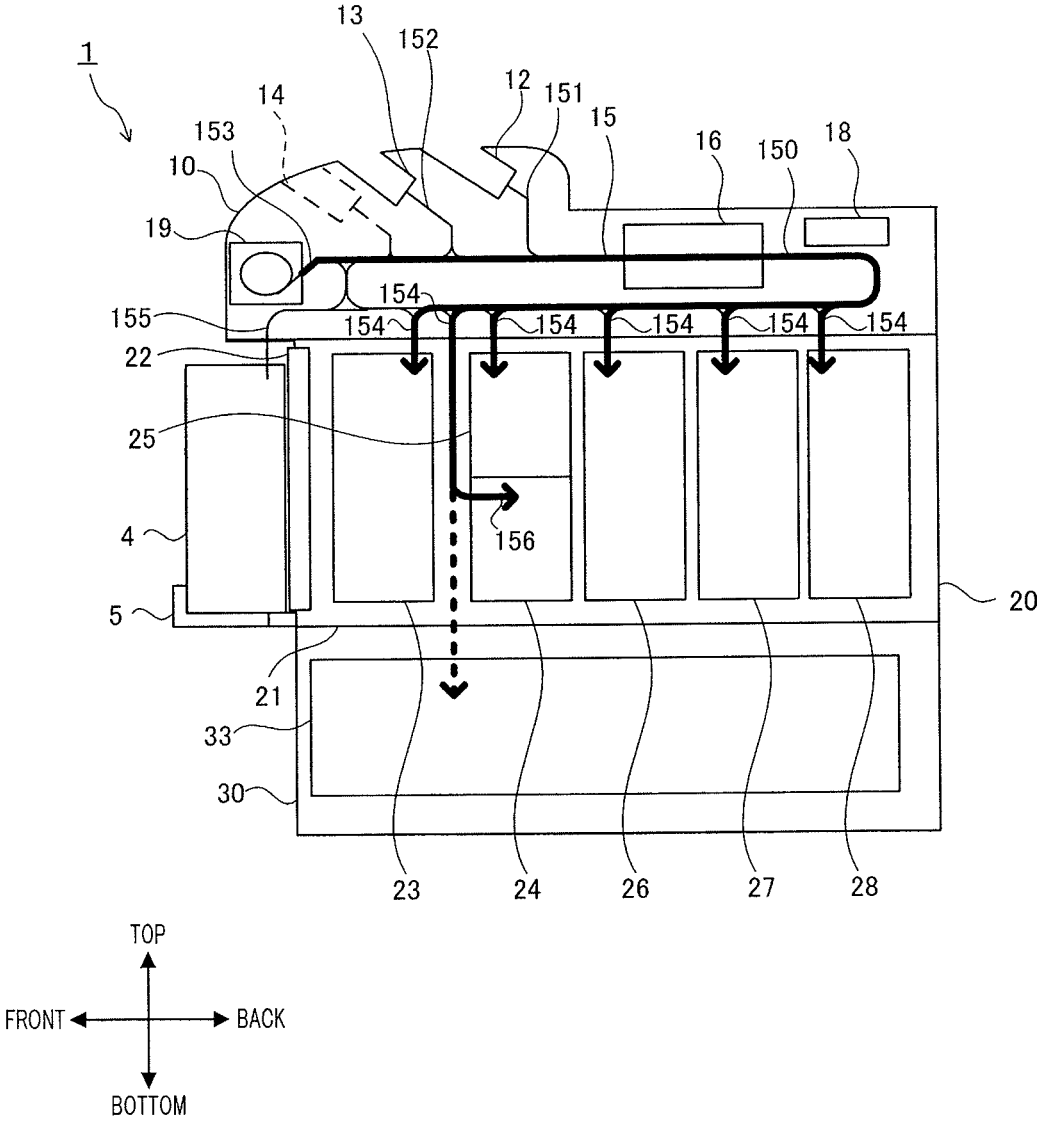
FIG. 4 is a diagram illustrating an example of the holding and depositing processing according to Embodiment 1.

Next, the holding and depositing processing is described. FIG. 3 and FIG. 4 are diagrams each illustrating an example of the holding and depositing processing according to Embodiment 1. FIG. 3 illustrates a state where the banknotes fed out from the depositing section 12 are stored in the temporary storage section 19, and FIG. 4 illustrates a state where the banknotes fed out from the temporary storage section 19 are stored in any of the first storage unit 23 to the sixth storage unit 28. Note that an arrow drawn by a dashed line in the figure indicates a transport path of the rejected banknotes rejected in the depositing processing.

The holding and depositing processing is depositing processing to store the banknotes recognized by the recognition unit 16 in the temporary storage section 19 once, and to store the banknotes in any of the first storage unit 23 to the sixth storage unit 28 after operation to accept depositing of the banknotes is performed.

In the present specification, processing to store the banknotes fed out from the depositing section 12 in the temporary storage section 19 is referred to as holding processing, and processing to store the banknotes fed out from the temporary storage section 19 in any of the first storage unit 23 to the sixth storage unit 28 is referred to as storing processing. In other words, the holding processing and the storing processing configure the holding and depositing processing.

In the holding and depositing processing, the banknotes are stored in any of the first storage unit 23 to the sixth storage unit 28 on the condition that the operation to accept the depositing is performed. Accordingly, if a transport error such as jam occurs during execution of the holding processing, the banknotes stagnating in the temporary storage section 19 and the loop transport path 150 are determined as depositing-unaccepted banknotes. In addition, if the transport error such as jam occurs during execution of the storing processing, the banknotes stagnating in the temporary storage section 19 and the loop transport path 150 are determined as depositing-accepted banknotes. Accordingly, even if an error such as the transport error occurs during execution of the holding and depositing processing, it is possible to quickly perform the recovery processing.

Further, in the holding and depositing processing, the read serial numbers of the banknotes are stored, in the reading order, in any of the temporary storage table and the first storage table to the sixth storage table that are provided respectively corresponding to the temporary storage section 19 and the first storage unit 23 to the sixth storage unit 28. This makes it possible to specify that each of the banknotes is stored in which storage unit in what order.

Figure 5:
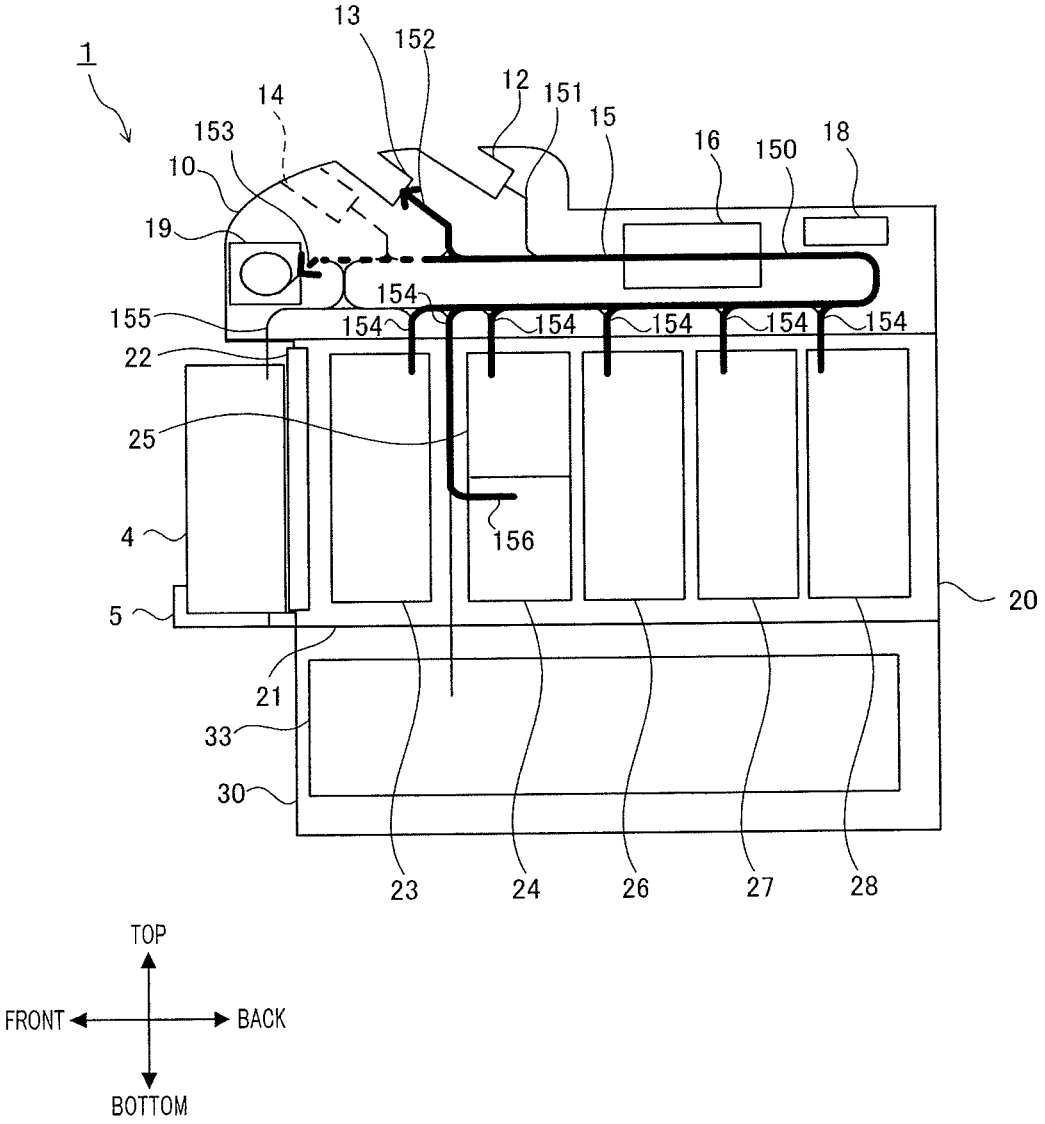
FIG. 5 is a diagram illustrating an example of dispensing processing according to Embodiment 1.

Next, the dispensing processing is described. FIG. 5 is a diagram illustrating an example of the dispensing processing according to Embodiment 1. FIG. 5 illustrates a state where the banknotes fed from the first storage unit 23 to the sixth storage unit 28 are transported to the dispensing section 13 through the recognition unit 16. Note that an arrow drawn by a dashed line in the figure indicates a transport path of the rejected banknotes rejected in the dispensing processing.

The dispensing processing is processing to dispense banknotes stored in the sheet processing apparatus 1.

When an operator instructs the sheet processing apparatus 1 to perform dispensing through a not-illustrated dispensing operation unit, the sheet processing apparatus 1 feeds out a designated number of banknotes of a designated denomination from each of the first storage unit 23 to the sixth storage unit 28. The transport unit 15 transports the fed banknotes to the recognition unit 16, and the recognition unit 16 recognizes the banknotes. Thereafter, the banknotes normally recognized are dispensed to the dispensing section 13.

The rejected banknotes occurred in the dispensing processing are transported to and stored in the temporary storage section 19. The banknotes stored in the temporary storage section 19 are stored in the collection section 33 or the like as necessary after the dispensing processing ends.

Figure 6:
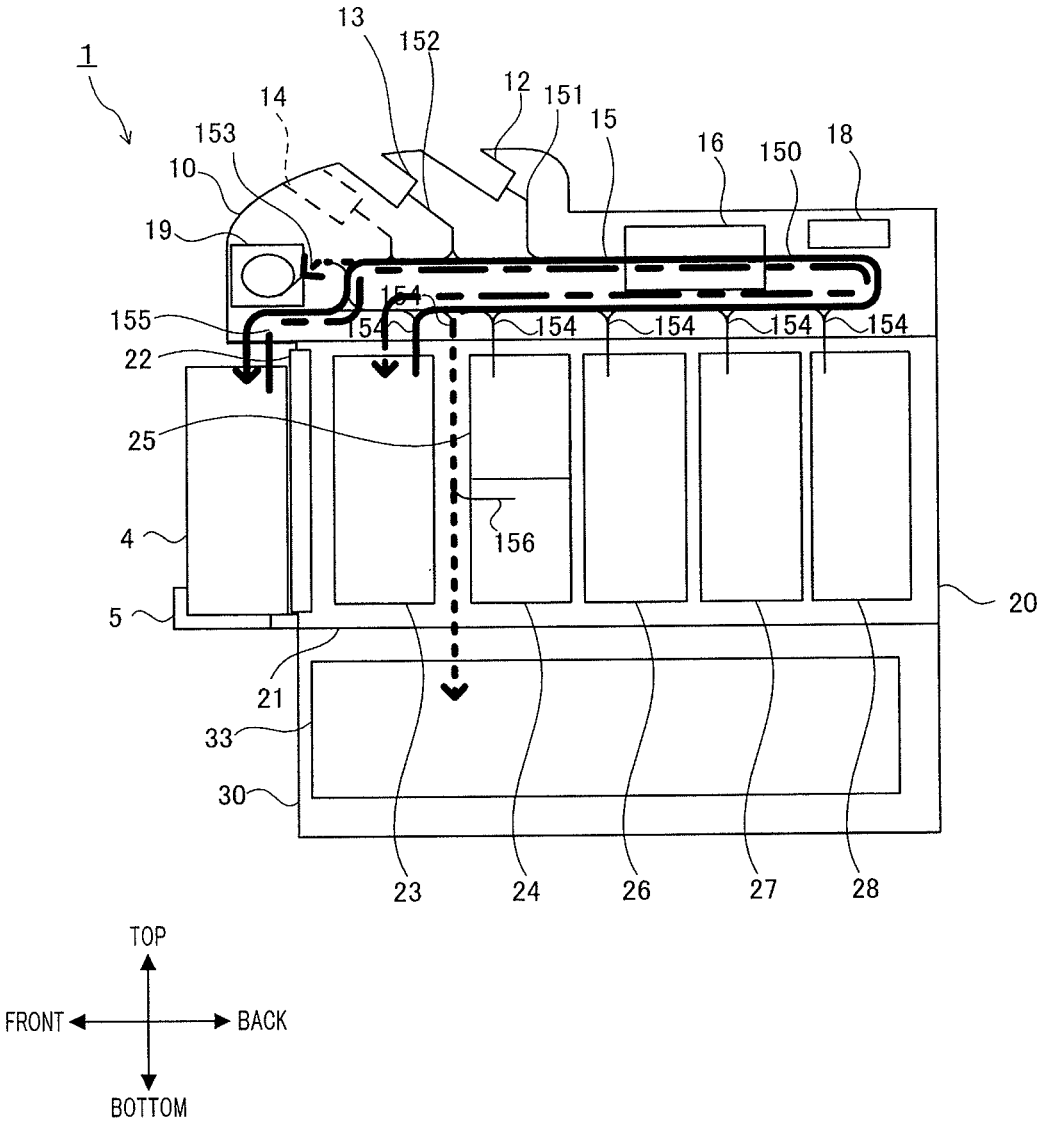
FIG. 6 is a diagram illustrating an example of reconciliation processing according to Embodiment 1.

Next, the reconciliation processing is described. FIG. 6 is a diagram illustrating the reconciliation processing according to the present embodiment. The reconciliation processing is processing to recount the number of banknotes stored in the first storage unit 23 to the sixth storage unit 28. The reconciliation processing may include processing to check whether the number of recounted banknotes is coincident with the number of banknotes that should be stored.

In the reconciliation processing, a reconciliation storage unit is used. Any one of the detachable storage unit 4, the temporary storage unit 19, and the first storage unit 23 to the sixth storage unit 28 can be used as the reconciliation storage unit. In the present embodiment, a case where the empty detachable storage unit 4 is used as the reconciliation storage unit is described. After the empty detachable storage unit 4 is attached to the sheet processing apparatus 1, the operator operates the sheet processing apparatus 1 to start the reconciliation processing.

The first storage unit 23 to the sixth storage unit 28 to be reconciled each feed out the stored banknotes one by one. The transport unit 15 transports the fed banknotes to the recognition unit 16. The recognition unit 16 recognizes the banknotes. The recognition unit 16 reads, for example, the serial numbers of the respective banknotes, and the read serial numbers are stored in the detachable-storage table.

The normally-recognized banknotes are transported to and stored in the detachable storage unit 4. In contrast, the rejected banknotes are transported to and stored in the temporary storage section 19, the collection section 33, or the like.

Note that, in the reconciliation processing in the present specification, a process after the banknotes are fed out from the storage unit to be reconciled until the banknotes are stored in the detachable storage unit 4 is referred to as primary transportation.

When recognition of all of the banknotes stored in the storage unit to be reconciled is completed, the banknotes stored in the detachable storage unit 4 are fed out one by one, and are transported by the transport unit 15 to an original storage unit, namely, the storage unit to be reconciled. At this time, the recognition unit 16 may perform recognition again. After the banknotes are recognized again, the normally-recognized banknotes are stored in the original storage unit, namely, the storage unit to be reconciled. The rejected banknotes are stored in the collection section 33 or the like.

Note that, in the reconciliation processing in the present specification, a process after the banknotes are fed out from the detachable storage unit 4 until the banknotes are stored in the original storage unit is referred to as secondary transportation.

Figure 7:
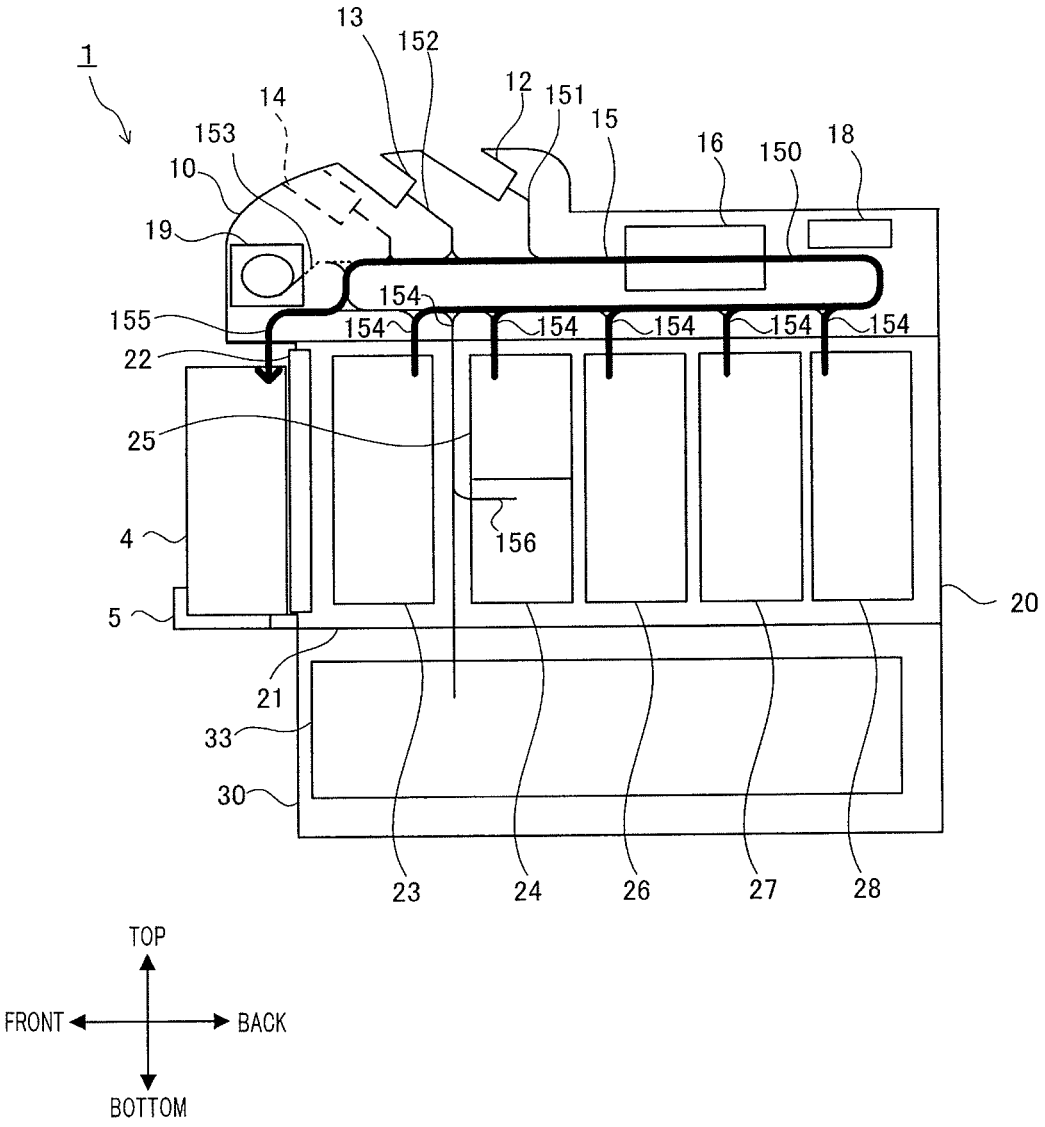
FIG. 7 is a diagram illustrating an example of collection processing according to Embodiment 1.

Next, the collection processing is described. FIG. 7 is a diagram illustrating an example of the collection processing according to the present embodiment. The collection processing is processing to store the banknotes stored in the first storage unit 23 to the sixth storage unit 28 in a collection storage unit. At least one of the detachable storage unit 4 and the collection section 33 can be used as the collection storage unit. In the present embodiment, a case where the detachable storage unit 4 is used as the collection storage unit is described.

After the detachable storage unit 4 is attached to the sheet processing apparatus 1, the operator who has attached the detachable storage unit 4 to the sheet processing apparatus 1 operates the sheet processing apparatus 1 to start the collection processing.

After the collection processing is started, a predetermined number of banknotes are sequentially fed out to the transport unit 15 from any of the first storage unit 23 to the sixth storage unit 28 storing the banknotes to be collected. The fed banknotes are transported to and recognized by the recognition unit 16. The banknotes that have been determined as normal in the recognition are transported to and stored in the detachable storage unit 4. The banknotes that have been recognized as the rejected banknotes in the recognition may be stored in the temporary storage section 19, the collection section 33, or the like.

Note that all of the banknotes in each of the storage units may be collected in place of collection of the predetermined number of banknotes. The processing to collect all of the banknotes corresponds to processing to empty the storage units. Therefore, the recognition unit 16 may recognize or may not recognize the banknotes fed out from each of the storage units. Alternatively, the banknotes may be directly transported to the detachable storage unit 4 without through the recognition unit 16.

Next, reading failure of the serial number occurred in the recognition unit 16 is described. FIG. 8 is a diagram illustrating the reading failure of the serial number. Here, the reading failure of the serial number occurred in the dispensing processing is described as an example.

FIG. 8 illustrates the serial numbers read at the depositing of the banknotes, and the serial numbers read at the dispensing of the banknotes. In this example, "?" in a string of characters configuring the serial number indicates a character that has not been normally read by the recognition unit 16.

An example in a first row among the serial numbers read at the dispensing indicates occurrence of reading failure on a character of a sixth digit that is a sixth character from the left in the serial number configured of a string of ten characters. The characters of digits other than the sixth digit are coincident with the characters of the serial number read at the depositing. In other words, the serial number read at the dispensing is not shifted in digit from the serial number read at the depositing. Note that, in the present specification, the number of digits of the serial number is counted from the left of the string of characters.

An example in a second row among the serial numbers read at the dispensing indicates occurrence of reading failure on all of the digits of the serial number configured of the string of ten characters.

An example in a third row among the serial numbers read at the dispensing indicates occurrence of reading failure on characters of a sixth digit to a ninth digit. In addition, characters of digits other than the sixth digit to the ninth digit correspond to the characters of the serial number read at the depositing. In other words, the serial number read at the dispensing is not shifted in digit from the serial number read at the depositing.

An example in a fourth row among the serial numbers read at the dispensing indicates occurrence of reading failure on characters of a fourth digit and a tenth digit. In addition, characters of digits other than first to third digits are not coincident with the characters of the serial number read at the depositing. Characters of fifth to ninth digits, however, are coincident with characters of sixth to tenth digits of the serial number read at the depositing.

In other words, the characters of the fifth to ninth digits in the serial number read at the dispensing are shifted in digit from the serial number read at the depositing.

In the sheet processing apparatus 1 according to Embodiment 1, in the dispensing processing, the serial number that has a predetermined relationship relating to a degree of coincidence with the serial number read at the dispensing is retrieved from the storage table in which the serial numbers read at the depositing are included. Further, the serial number read at the dispensing is subjected to correction processing with use of the serial number found out in the retrieval. As a result, the serial number that has not been read by the recognition unit 16 is corrected. For example, the correction processing may be processing to replace the serial number read at the dispensing with the serial number found out in the retrieval.

The predetermined relationship is appropriately set as necessary. For example, the predetermined relationship may be a relationship in which the serial number read at the dispensing and the serial number read at the depositing are completely coincident with each other. Further, the predetermined relationship may be a relationship in which the serial number read at the dispensing and the serial number read at the depositing are not completely coincident but partially coincident with each other.

In the present embodiment, the predetermined relationship means that the serial number read at the dispensing and the serial number read at the depositing have a predetermined number or more of common digits, or the serial number read at the dispensing and the serial number read at the depositing have a string of a predetermined number or more of characters arranged in the same order.

Next, flow of the dispensing processing is described with reference to FIG. 9 that illustrates an example of the flow of the dispensing processing according to Embodiment 1. In the following, a case where the banknotes stored in the first storage unit 23 are dispensed is described. The banknotes stored in each of the second storage unit 24 to the sixth storage unit 28 are also dispensed in the same flow.

When the dispensing processing is started, feeding processing (step S10) is executed, and the banknotes are fed out from the first storage unit 23. The banknotes are fed out in an order reverse to the storing order to the first storage unit 23. For example, a banknote fed first is a banknote stored in the first storage unit 23 at last, and a banknote fed second is a banknote stored in the first storage unit 23 second from the last. The fed banknotes are transported toward the recognition unit 16.

Reading processing (step S20) is executed continuously from the feeding processing, and the serial numbers of the respective banknotes are read by the recognition unit 16. Note that, in the reading processing, information such as a denomination, fitness, and authenticity of each of the banknotes is also read.

After the reading processing (step S20) ends, it is determined whether the number of digits of the serial number that has not been read in the reading processing is N or more (step S30). The value N is set to, for example, "4". The value N may be set for a type of the banknote or for each of the storage units in which the banknotes are stored. Note that, in the following, the description is given, assuming that the value N is set to "4".

In a case where the number of characters of the serial number that has not been read in the reading processing is four or more (Yes in step S30), temporary storing processing (step S100) is executed. The temporary storing processing is described below. In a case where the number of digits of the serial number that has not been read in the reading processing is lower than four (No in step S30), retrieval processing (step S40) is executed.

The retrieval processing is processing to retrieve the serial number having the predetermined relationship relating to a degree of coincidence with the serial number read by the recognition unit 16 in the reading processing (step S20), from the serial numbers including in the first storage table 41. In other words, the retrieval processing is processing to retrieve the serial number included in the first storage table 41 which partly or completely correspond to the serial number recognized by the recognition unit 16.

The retrieval processing is described with reference to FIG. 10. FIG. 10 is a diagram illustrating the retrieval processing according to Embodiment 1.

A reference numeral 40 in FIG. 10 indicates a table in which the serial numbers of the banknotes read in the reading processing (step S20) are arranged in a feeding order.

A reference numeral 41 in FIG. 10 indicates the first storage table 41. The first storage table 41 is a serial number list which includes the serial numbers of the banknotes stored in the first storage unit 23 in the depositing processing.

The order of the serial numbers included in the first storage table 41 corresponds to the order of the banknotes stored in the first storage unit 23. In other words, the serial number of the banknote previously stored in the first storage unit 23 is included in lower side, and the serial number of the banknote stored in the first storage unit 23 afterward is stored in upper side. The first storage table 41 illustrated in FIG. 10 indicates that 28 banknotes are stored in the first storage unit 23, and the serial number of the 28th banknote is "A123456789".

A reference numeral 48 in FIG. 10 indicates the dispensing table in which the serial numbers of the dispensed banknotes are stored. The serial numbers included in the dispensing table 48 are serial numbers read at the dispensing, or the serial numbers obtained by correcting the serial numbers read at the dispensing with use of the serial numbers included in the first storage table 41.

In the retrieval processing, the whole of the first storage table 41 may be set as a retrieval range, or a predetermined range of the first storage table 41 may be set as the retrieval range in place of the whole of the first storage table 41. The predetermined range is a range including a retrieval-target serial number with high possibility. The predetermined range is specifically set in the following manner.

First, the storing order, to the first storage unit 23, of the banknote with the retrieval-target serial number is determined from the feeding order of the banknotes. For example, the storing order, to the first storage unit 23, of the banknote fed seventh is determined as 22nd.

Subsequently, the serial number of the banknote stored in the determined order, the serial numbers of a predetermined number of banknotes stored after the determined order (hereinafter, "banknotes in first range"), and the serial numbers of a predetermined number of banknotes stored before the determined order (hereinafter, "banknotes in second range") are set as the predetermined range. For example, the serial number of the banknote stored 22nd, the serial numbers of four banknotes stored after the 22nd banknote (banknotes stored 23rd to 26th), and the serial numbers of 15 banknotes stored before the 22nd banknote (banknotes stored 21st to 7th) are set as the predetermined range.

Setting the retrieval range in the above-described manner achieves the following advantages. First, it is unnecessary to retrieve the whole of the first storage table 41. This makes it possible to efficiently find out the retrieval-target serial number in a shorter time.

Second, the serial numbers of the banknotes in the first range are included in the predetermined range. Therefore, even if a transport error in which the banknote stored afterward is fed out after the banknote previously stored occurs, it is possible to find out the retrieval-target serial number. For example, a case where the banknote with the serial number "F678912345" that is originally fed out sixth is fed out seventh by being changed in order is considered. In this case, the serial number of the banknote stored after the 22nd banknote (specifically, 23rd banknote) is also included in the retrieval range. Thus, it is possible to find out the retrieval-target serial number "F678912345".

Third, the serial numbers of the banknotes in the second range are included in the predetermined range. Therefore, even if a transport error in which a plurality of banknotes is fed out while being overlapped with one another, namely, an overlapping transport error occurs, it is possible to find out the retrieval-target serial number. For example, a case where the banknote to be fed out sixth and the banknote to be fed out seventh are fed out while being overlapped with each other is considered. In this case, the banknote fed out seventh in appearance is a banknote with the serial number "H891234567" to be originally fed out eighth. Even when such a phenomenon occurs, it is possible to find out the retrieval-target serial number "H891234567" because the serial number of the banknote stored before the 22nd banknote (specifically, 21st banknote) is also included in the retrieval range.

If the overlapping transport error occurs, the overlapping transport error continuously influences the feeding order of the banknotes fed out after the overlapping transport error. Further, the influence of the overlapping transport error is accumulated. Accordingly, the number of banknotes in the second range is preferably made larger than the number of banknotes in the first range. Note that the number of banknotes in the first range and the number of banknotes in the second range may be made equal to each other.

The retrieval range is not limited to the above-described range, and may be appropriately set. In a case where efficiency of the retrieval is not important, setting the whole of the first storage table 41 as the retrieval range makes it possible to reduce the retrieval error.

Further, in the retrieval processing, the retrieval order of the first storage table 41 may be set. For example, among the serial numbers in the first storage table 41, the serial number in the storing order corresponding to the feeding order of the banknote is first retrieved. Next, the retrieval is performed on the first range in order from the serial number, the storing order of which is close to the storing order corresponding to the feeding order of the banknote. Next, the retrieval is performed on the second range in order from the serial number, the storing order of which is close to the storing order corresponding to the feeding order of the banknote. As a result, when the serial number having the predetermined relationship relating to a degree of coincidence is found out, the subsequent retrieval can be omitted. Alternatively, in a case where the retrieval is performed on the whole of the retrieval ranges and a plurality of serial numbers equivalent in coincidence degree is found out, the corresponding serial number may be determined based on the retrieval order.

Figure 9:
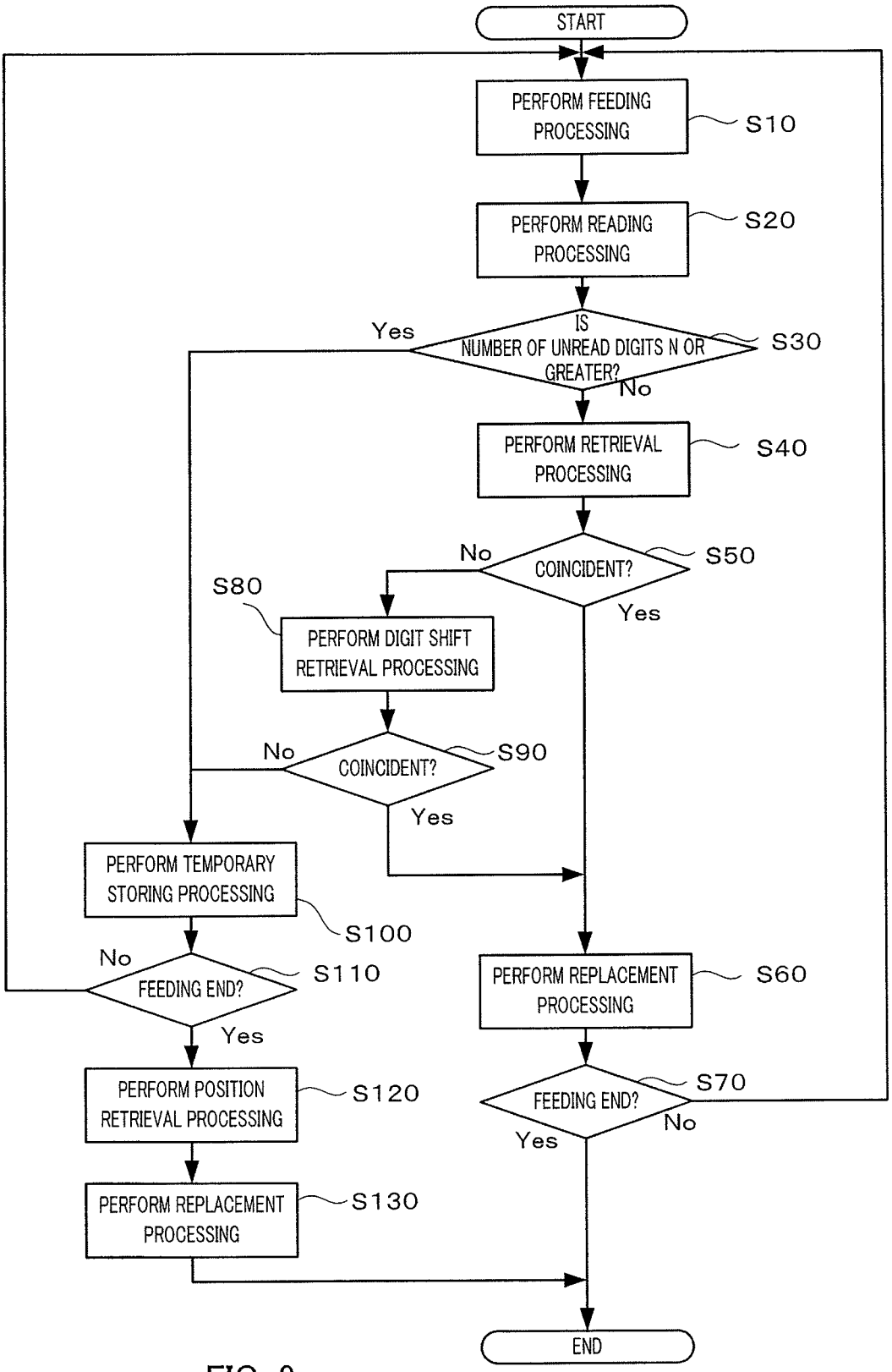
FIG. 9 is a flowchart illustrating an example of flow of the dispensing processing according to Embodiment 1.

Referring back to description of FIG. 9, it is determined whether, as a result of the retrieval processing (step S40), the serial number having the predetermined relationship relating to a degree of coincidence with the serial number read in the reading processing has been found out (step S50).

For example, in FIG. 10, in the serial number in the feeding order of "1", reading failure occurs on the character of the sixth digit; however, the characters of the other digits are coincident with the characters of the serial number in the storing order of "28" in the first storage table 41. In this case, it is determined that the serial number read at the dispensing and the serial number in the storing order of "28" in the first storage table 41 have the predetermined relationship relating to a degree of coincidence.

Referring back to description of FIG. 9, in a case where the serial number having the predetermined relationship relating to a degree of coincidence is found out from the serial numbers stored in the first storage table 41 (Yes in step S50), replacement processing (step S60) is executed. The replacement processing is an example of the correction processing, and is processing to replace the serial number read in the reading processing (step S20) with the serial number found out from the first storage table 41. In addition, in the replacement processing, the replaced serial number is included in the dispensing table 48. The correction processing may be processing to determine whether it is necessary to perform replacement for each digit of the serial number. For example, the correction processing may be processing to replace only the digit at which the character of the serial number read in the reading processing (step S20) and the character of the serial number found out from the first storage table 41 are different from each other. Further, in a case where the serial number found out from the first storage table 41 includes a character "?" that has not been normally read and the corresponding digit of the serial number read in the reading processing (step S20) has been normally read, the replacement processing may not be performed.

After the replacement processing (step S60) ends, it is determined whether the feeding out of the banknotes from the first storage unit 23 has ended (step S70). In a case where it is determined that the feeding out of the banknotes from the first storage unit 23 has ended (Yes in step S70), the dispensing processing ends.

In a case where the serial number having the predetermined relationship relating to a degree of coincidence has not been found out from the serial numbers stored in the first storage table 41 (No in step S50), digit shift retrieval processing (step S80) is executed.

The digit shift retrieval processing is processing to retrieve the serial number that has a string of a predetermined number or more of characters arranged in the same order as the serial number read in the reading processing (step S20), from the serial numbers included in the first storage table 41. The predetermined number of characters may be set to an optional number, and is, for example, six. The two serial numbers having the common string of the predetermined number or more of successive characters have the predetermined relationship relating to a degree of coincidence.

In the digit shift retrieval processing (step S80), the retrieval is performed except for the characters that have not been read. For example, in FIG. 10, reading failure of the character occurs on the fourth digit and the tenth digit in the serial number of the banknote in the feeding order of "7".

In this case, the retrieval is performed with use of the string of characters except for "?" in the fourth digit and "?" in the tenth digit. In other words, the serial number that includes eight characters "G7823456" in the order mentioned is retrieved.

The serial number in the storing order of "22" in the first storage table 41 includes different characters in the fourth digit and the fifth digit; however, the serial number includes the eight characters "G7823456". Accordingly, the serial number in the storing order of "22" in the first storage table 41 is found out.

The above-described processing makes it possible to find out the serial number having the predetermined relationship relating to a degree of coincidence with the serial number read with digit shift, from the first storage table 41.

Next, it is determined whether, in the digit shift retrieval processing (step S80), the serial number having the predetermined relationship relating to a degree of coincidence has been found out (step S90).

In a case where the serial number having the predetermined relationship relating to a degree of coincidence has been found out in the digit shift retrieval processing (Yes in step S90), the replacement processing (step S60) is executed.

In a case where the serial number having the predetermined relationship relating to a degree of coincidence has not been found out in the digit shift retrieval processing (No in step S90), the temporary storing processing (step S100) is performed.

The temporary storing processing (step S100) is processing executed in the case where the number of characters of the serial number that has not been read in the reading processing (step S20) is four or more or in the case where the serial number having the predetermined relationship relating to a degree of coincidence has not been found out in the digit shift retrieval processing.

The temporary storing processing (step S100) is processing to transport, to the temporary storage section 19, the banknote having the serial number in which four or more characters have not been read in the reading processing or the banknote having the serial number in which the serial number having the predetermined relationship relating to a degree of coincidence has not been found out in the digit shift retrieval processing. At the same time, the serial number of the banknote is included in the temporary storage table (not illustrated).

For example, in FIG. 10, the banknote in the feeding order of "2" is not dispensed but is transported to the temporary storage section 19 because four or more characters have not been read in the reading processing. In addition, "??????????" is included in the temporary storage table as the serial number of the banknote.

Further, in FIG. 10, the banknote in the feeding order of "11" is similarly processed.

After the temporary storing processing (step S100) ends, it is determined whether the feeding out of the banknotes from the first storage unit 23 has ended (step S110). In a case where it is determined that the feeding out of the banknotes from the first storage unit 23 has not ended (No in step S110), the processing subsequent to the feeding processing (step S10) is executed again.

In a case where it is determined that the feeding out of the banknotes from the first storage unit 23 has ended (Yes in step S110), position retrieval processing (step S120) is executed.

The position retrieval processing (step S120) is processing in a case where the serial number having the predetermined relationship relating to a degree of coincidence with a first serial number read in the reading processing is not included in the serial number list of the first storage table 41. In the position retrieval processing, a second serial number that has been read in the reading processing and is different from the first serial number is used. The serial number having the predetermined relationship relating to a degree of coincidence with the second serial number is retrieved in the serial number list of the first storage table 41. The first serial number is made correspond to the serial number in the serial number list with reference to the serial number in the list.

As an example of the position retrieval processing, the serial numbers of the banknotes fed out before and after the banknote transported to the temporary storage section 19 in the temporary storage processing, are specified from the dispensing table 48, and the serial number sandwiched between the specified serial numbers is further retrieved in the first storage table 41.

For example, the serial numbers of the second banknotes fed out before and after the first banknote in the feeding order of "2" are specified as the serial number "A123456789" in the feeding order of "1" and the serial number "C345678912" in the feeding order of "3" in the dispensing table 48. Moreover, when the serial number sandwiched between these serial numbers is retrieved in the first storage table 41, the serial number "B234567891" in the feeding order of "27" is specified.

Further, the serial numbers of the second banknotes fed out before and after the first banknote in the feeding order of "11" are specified as the serial number "J123456789" in the feeding order of "10" and the serial number "M456789123" in the feeding order of "12" in the dispensing table 48. In addition, when the serial number sandwiched between these serial numbers is retrieved in the first storage table 41, the serial number "L345678912" in the feeding order of "17" and the serial number "K234567891" in the feeding order of "18" are specified.

In this case, the banknotes in the feeding order of "11" are two banknotes that are fed out while being overlapped with each other and stored in the temporary storage section 19.

Referring back to the description of FIG. 9, after the position retrieval processing (step S120) ends, the replacement processing (step S130) as the correction processing is executed. In the replacement processing (step S130), the serial number stored in the temporary storage table is replaced with the serial number specified in the position retrieval processing (step S120).

For example, in FIG. 10, the serial number "??????????" of the banknote in the feeding order of "2" is replaced with "B234567891", the serial number "??????????" of the banknote in the feeding order of "11" is replaced with "L345678912", and the serial number "K234567891" is added to the temporary storage table.

After the replacement processing ends, the dispensing processing ends. At this time, the banknote stored in the temporary storage section 19 may be returned to the first storage unit 23.

As described above, in Embodiment 1, the serial number having the predetermined relationship relating to a degree of coincidence with the serial number read in the recognition unit 16 in the dispensing processing is retrieved in the serial numbers stored in the first storage table 41.

Accordingly, even if the orders of the banknotes fed out at the dispensing are different from the orders at the depositing, it is possible to specify the banknotes to be dispensed.

Further, in Embodiment 1, in the case where the string of six or more characters in the string of ten characters configuring the serial number is read, the serial number having the predetermined relationship relating to a degree of coincidence with the read serial number is retrieved from the serial numbers included in the first storage table 41. Accordingly, it is possible to quickly retrieve the coincident serial number from the serial numbers stored in the first storage table 41.

Moreover, in Embodiment 1, in the case where the four or more characters in the string of ten characters configuring the serial number have not been read, the serial number is specified from the serial numbers of the banknotes fed out before and after. Accordingly, even if the plurality of banknotes is fed out while being overlapped with one another, it is possible to specify the serial numbers of these banknotes.

Note that the above-described processing may be performed in the dispensing processing to dispense the banknotes from the other storage units.

For example, when the banknotes are dispensed from the detachable storage unit 4, the dispensing processing described with reference to FIG. 9 may be performed. In this case, the detachable storage unit 4 is attached to, for example, a depositing apparatus that is different from the sheet processing apparatus 1 performing the dispensing processing, and the banknotes are stored. When the banknotes are stored in the detachable storage unit 4, a recognition unit of the depositing apparatus reads serial numbers of the banknotes.

Further, the detachable storage unit 4 comprises a memory section such as a memory, and the serial numbers read by the depositing apparatus are included in the storage table in the memory section of the detachable storage unit 4.

When the detachable storage unit 4 is detached from the depositing apparatus and is attached to the attachment section 5 of the sheet processing apparatus 1, data of the storage table in the memory section of the detachable storage unit 4 is transmitted to the memory section of the sheet processing apparatus 1.

In the dispensing processing, the serial number having the predetermined relationship relating to a degree of coincidence is retrieved from the serial numbers included in the storage table, transmitted from the detachable storage unit 4.

Note that transmission of the data of the serial numbers stored in the storage table from the detachable storage unit 4 to the sheet processing apparatus 1 is not essential, and the serial number having the predetermined relationship relating to a degree of coincidence may be retrieved from the serial numbers included in the storage table in the memory section of the detachable storage unit 4. In this case, the memory section may not be provided in the sheet processing apparatus 1.

Further, providing of the memory section in the detachable storage unit 4 is not essential, and the serial numbers read by the depositing apparatus may be included in, for example, a storage table provided on a server. In this case, at the dispensing, the serial number having the predetermined relationship relating to a degree of coincidence may be retrieved from the serial numbers stored in the storage table provided on the server.

In Embodiment 1, the processing to correct the serial number in the dispensing processing is described as an example. The processing to correct the serial number, however, may be executed in the processing other than the dispensing processing.

For example, in the storing processing in the holding and depositing processing, the serial numbers that have been read when the banknotes are fed out from the temporary storage section 19 may be corrected with use of the serial numbers that have been read when the banknotes are stored in the temporary storage section 19.

In addition, when the secondary transportation in the reconciliation processing is executed, the serial numbers read in the secondary transportation may be corrected with use of the serial numbers read in the primary transportation.

In the case when the collection processing is executed, the serial numbers read in the collection processing may be corrected with use of the serial numbers read in the depositing processing.

Embodiment 2

The sheet processing apparatus 1 according to Embodiment 2 has features similar to the features of the sheet processing apparatus 1 according to Embodiment 1. In other words, in Embodiment 2, the serial number having the predetermined relationship relating to a degree of coincidence with the serial number read at the dispensing is retrieved from the storage table in which the serial numbers read at the depositing are stored, and the serial numbers read at the dispensing are corrected with use of the serial number read at the depositing, in the dispensing processing.

The sheet processing apparatus 1 according to Embodiment 2 does not perform recognition of fitness and authenticity of the banknotes in the dispensing processing, and information on fitness and authenticity of the banknotes read at the depositing is used as it is.

The depositing processing according to Embodiment 2 is described with reference to FIG. 11 and FIG. 12. The processing relating to the serial numbers in the depositing processing executed by the sheet processing apparatus 1 according to Embodiment 2 is similar to the processing executed by the sheet processing apparatus 1 according to Embodiment 1. Accordingly, description of the processing is omitted.

FIG. 11 is a diagram illustrating an example of any of the first storage table 41 to the sixth storage table according to Embodiment 2.

Information such as a denomination, a serial number, a category, an authenticity factor, and a fitness factor is stored in the storage table 50 in the storing order of the banknotes in each of the storage units.

In FIG. 11, USD represents U.S. dollars, and FIG. 11 illustrates that the banknotes of the identical denomination are stored in the storage units. In FIG. 11, the category represents whether each of the banknotes is any of a counterfeit note, a suspect note, a fit note of a genuine note, and an unfit note of a genuine note. For example, 4A indicates a fit note of a genuine note, and 4B indicates an unfit note of a genuine note.

In FIG. 11, the fitness factor is information represents whether each of the banknotes is a fit note or an unfit note. In a case where the banknote is an unfit note, the fitness factor indicates a reason of the unfit note. For example, a factor 1 indicates dirt of the banknote, a factor 2 indicates tear of the banknote, and a factor 3 indicates a partial mutilation of the banknote.

FIG. 12 is a diagram illustrating an example of a dispensing table according to Embodiment 2. The banknote information such as a denomination, a serial number, a category, an authenticity factor, and a fitness factor is stored in a dispensing table 51 in the dispensing order of the banknotes.

In the dispensing processing, the banknotes are fed out from the storage units, and the fed banknotes are transported toward the recognition unit 16. The recognition unit 16 recognizes the banknote information on each of the transported banknotes. At this time, the recognition unit 16 recognizes at least the denomination and the serial numbers.

The denomination read by the recognition unit 16 is stored in the dispensing table 51. Further, the read serial numbers are corrected with use of the serial numbers read at the depositing, in a manner similar to Embodiment 1.

Moreover, as for the category, the authenticity factor, and the fitness factor, the information stored together with the serial numbers read at the depositing is stored in the storage table 50.

As a result, it is possible to reduce a load of the recognition processing at the dispensing, and to quickly perform the dispensing processing.

Note that, in the dispensing processing, the recognition unit 16 may perform recognition of authenticity and fitness, in addition to the recognition of the denomination and the serial numbers. In a case where information on fitness or authenticity of the banknotes read at the depositing and information on fitness or authenticity of the banknotes read at the dispensing are compared, and a difference degree satisfies a predetermined condition, the information on fitness or authenticity of the banknotes read at the dispensing may be stored in the dispensing table 51. This makes it possible to prevent, for example, the banknotes damaged during the transportation from being dispensed.

Although the processing executed at the dispensing is described in Embodiment 2, the processing may be executed in various kinds of processing by the sheet processing apparatus 1, as with Embodiment 1.

INDUSTRIAL APPLICABILITY

The present invention is widely usable in the sheet processing apparatus and the sheet processing method.

REFERENCE SIGNS LIST

1 Sheet processing apparatus
4 Detachable storage unit
5 Attachment section
10 Upper housing
12 Depositing section
13 Dispensing section
14 Second dispensing section
15 Transport unit
150 Loop transport path
151 First diversion path
152 Second diversion path
153 Third diversion path
154 Fourth diversion path
155 Fifth diversion path
156 Sixth diversion path
16 Recognition unit
18 Control section
19 Temporary storage section
20 Lower housing
21 First storage box
23 First storage unit
24 Second storage unit
25 Third storage unit
26 Fourth storage unit
27 Fifth storage unit
28 Sixth storage unit
30 Second storage box
40 Table
41 First storage table
48 Dispensing table
50 Storage table
51 Dispensing table

The invention claimed is:

1. A sheet processing apparatus, comprising:

a depositing section configured to deposit sheets each having a serial number from outside of the sheet processing apparatus to inside of the sheet processing apparatus in a depositing process;

a dispensing section configured to dispense the deposited sheets to outside of the sheet processing apparatus in a dispensing process;

a storage unit configured to store therein the sheets deposited inside of the sheet processing apparatus by the depositing section and feed out the stored sheets therefrom;

a transport unit configured to transport the deposited sheets from the depositing section to the storage unit in the depositing process, and the stored sheets from the storage unit to the dispensing section in the dispensing process;

a recognition unit configured to read the serial number of the sheets transported from the depositing section to the storage unit by the transport unit in the depositing process, and read the serial numbers of the sheets transported from the storage unit to the dispensing section in the dispensing process;

a control section configured to create a serial number list including the serial number of the sheets read by the recognition unit in the depositing process; and a memory section configured to store therein the serial number list created by the control section, wherein the control section is configured, in the dispensing process, to perform a retrieval, from the serial number list stored in the memory section, a serial number having a predetermined relationship relating to a degree of coincidence with the serial number of any of the sheets read by the recognition unit in the dispensing process.

2. The sheet processing apparatus according to claim 1, the storage unit further comprising a detachable storage unit that is configured to be detachably attached to the sheet processing apparatus and a depositing apparatus different from the sheet processing apparatus and is configured to store therein sheets when the detachable storage unit is attached to the depositing apparatus, wherein the sheet processing apparatus is configured to receive the sheets stored in the detachable storage unit when the detachable storage unit is attached to the sheet processing apparatus;

the detachable storage unit is provided with a memory device configured to store the serial number list; and the control section is configured to cause the memory device to store the serial number list received from the depositing apparatus by reading the serial number of the sheet when the detachable storage unit which is storing the sheets therein is attached to the sheet processing apparatus.

3. The sheet processing apparatus according to claim 1, wherein the serial number having the predetermined relationship partly or completely corresponds to the serial number of any of the sheets read by the recognition unit in the dispensing process.

4. The sheet processing apparatus according to claim 3, wherein the serial number having the predetermined relationship and the corresponding serial number in the serial number list have a common string of a predetermined number or more of successive characters.

5. The sheet processing apparatus according to claim 3, wherein the control section replaces the serial number read by the recognition unit in the dispensing processing, with the serial number which is retrieved from the serial number list by the control section when the serial number of the predetermined relationship relating to the degree of coincidence with the serial number read in the dispensing processing is found out, based on a result of the retrieval.

6. The sheet processing apparatus according to claim 5, wherein the memory section is further configured to store therein a dispensing list, the dispensing list including the serial number read by the recognition unit in the dispensing process; and the control section is configured to replace the serial number in the dispensing list.

7. The sheet processing apparatus according to claim 3, wherein, when the serial number read by the recognition unit in the dispensing processing corresponds to none of the serial numbers in the serial number list, the control section replaces the serial number read in the dispensing process with use of digit shift retrieval processing to retrieve the serial number that has a string of a predetermined number or more characters arranged in the same order as the serial number read by the recognition unit in the dispensing process.

8. The sheet processing apparatus according to claim 1, further comprising a storage box that is lockable, wherein the storage unit is disposed inside the storage box.

9. The sheet processing apparatus according to claim 1, wherein the storage unit is a winding-type storage unit in which a plurality of sheets are stored while being wound around a rotor.

10. The sheet processing apparatus according to claim 1, wherein the control section is configured to perform the retrieval when a number of digits of the serial number that has not been read in the dispensing process is smaller than a predetermined number of digits.

* * * * *